US005324696A

United States Patent [19]

Bonifay et al.

[11] Patent Number: 5,324,696

[45] Date of Patent: Jun. 28, 1994

[54] PROCESS AND HEAT EXCHANGE APPARATUS FOR SOLID PARTICLES FOR DOUBLE REGENERATION IN CATALYTIC CRACKING

[75] Inventors: Regis Bonifay, Asnieres; Frederic Hoffmann, Paris; Renaud Pontier, Vienne; Thierry Gauthier, Saint Genis Laval, all of France

[73] Assignee: Institut Francais du Petrole, Rueil Malmaison, France

[21] Appl. No.: 976,044

[22] Filed: Nov. 13, 1992

[30] Foreign Application Priority Data

Nov. 14, 1991 [FR] France ..... 91 14153

[51] Int. Cl.[5] ..... B01J 38/34; B01J 38/32; B01J 28/38; C10G 11/18

[52] U.S. Cl. ..... 502/43; 208/164; 422/144; 502/41

[58] Field of Search ..... 502/41-44; 208/164

[56] References Cited

U.S. PATENT DOCUMENTS

| | | | |
|---|---|---|---|
| 2,735,802 | 2/1956 | Jahnig | 422/144 |
| 4,434,245 | 2/1984 | Lomas et al. | 502/41 |
| 4,614,726 | 9/1986 | Walters et al. | 502/41 |
| 4,615,992 | 10/1986 | Murphy | 502/43 |
| 4,923,834 | 5/1990 | Lomas | 502/44 |
| 4,965,232 | 10/1990 | Mauleon et al. | 502/43 |
| 5,120,691 | 6/1992 | Pontier et al. | 502/43 |
| 5,212,129 | 5/1993 | Lomas | 502/43 |

FOREIGN PATENT DOCUMENTS 2626342 9/1989 France .

*Primary Examiner*—Paul E. Konopka

*Attorney, Agent, or Firm*—Millen, White, Zelano & Branigan

[57] ABSTRACT

A catalyst, e.g., a cracking catalyst, and a part of the regeneration fumes are drawn off from the dense catalytic bed of a second regenerator (9) and are introduced by force of gravity into an external exchanger (21) at a junction point beneath the level of the dense bed of the second regenerator. The heat exchange takes place in the bottom part of the exchanger below the junction point. Between the bottom end of the exchanger and the region above the junction point a dense bed zone is formed at a level which is substantially at the height of the dense bed in the regenerator and a discharge zone (27), of suitable size, for the regeneration gases and fluidization gas. The gases and fumes from the exchanger are removed in the diluted fluidized phase from the second regenerator through a conduit (28), while the catalyst is recycled in to the bed of the first regenerator through a conduit (34).

21 Claims, 1 Drawing Sheet

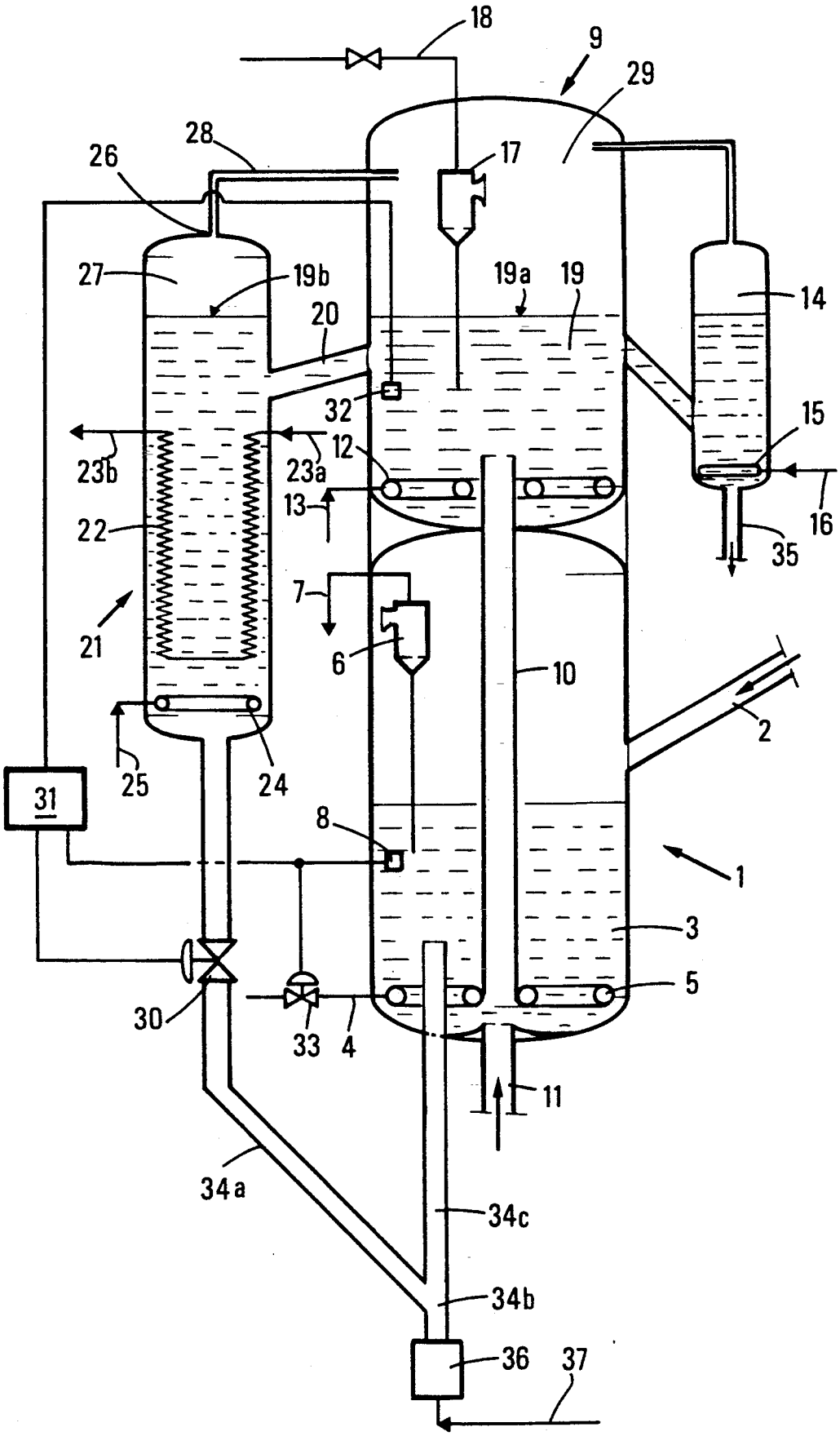
18
9
29
28
26
17
27
19b
19a
19
14
20
32
15
12
23b
23a
13
16
22
35
7
21
6
10
2
25
24
31
8
1
3
5
30
33
4
11
34a
34c
34b
36
37

PROCESS AND HEAT EXCHANGE APPARATUS FOR SOLID PARTICLES FOR DOUBLE REGENERATION IN CATALYTIC CRACKING

FIELD OF THE INVENTION

The invention relates to a process for the regeneration of a spent catalyst, with heat exchange in fluidized bed, and an apparatus for implementation of this process. More particularly, the process can be applied to the regeneration of catalysts which are in particular charged with hydrocarbon residues and coke after they have reacted with a hydrogen charge. The invention can relate to hydrotreatment, hydro-cracking or catalytic catalysts, reshaping catalyst or even ay contact mass, for example, used in thermal cracking processes.

As a purely illustrative example, the process will be applied to the regeneration of a spent catalyst from a catalytic cracking process, in fluidized bed, of heavy charges with a high Conradson carbon, such as an atmospheric residue, a residue under vacuum, or a non-asphalt containing residue, these residues being able to be hydro-treated.

The process is used, in particular, for temperature control.

BACKGROUND OF THE INVENTION

Catalytic cracking processes convert hydrocarbon charges into lighter products such as gasolines. To begin with, the charges are quite light like gas oils, for example, and in order to obtain a maximum conversion efficiency from the very active zeolite catalysts it is necessary to draw off the maximum amount of coke deposited on the catalysts which rendered them less active during a regeneration stage at a temperature of between 520° and 800° C.

Due to the pressing for fuels, those within the refining industry have become interested in increasingly heavy charges comprising hydrocarbons with a high boiling point, such as a boiling point which is above 550° C., for example, and with a high Conradson carbon or a significant metal concentration. A large amount of coke and hydrocarbons can thus become deposited on the catalyst during the catalytic cracking phase, and regeneration of the catalyst by combustion can cause significant heat discharge which can adversely affect the apparatus and render the catalyst inactive, particularly during lengthy exposure to temperature above 800° C. Controlled regeneration of the catalyst is therefore imperative. The problem occurs in particular when a process involving a technique in existence for a long time which basically treats conventional hydrocarbon charges is used for much heavier charges.

One of the aims of the invention is therefore to propose a regeneration process and apparatus with controlled cooling of the catalyst in a catalytic cracking unit with a view to treating heavy charges.

Another object of the invention is to make an apparatus easier to use.

The prior art is illustrated by the following patents:

U.S. Pat. No. 4,614,726 discloses an apparatus which has a regenerator, wherein the regeneration temperature is controlled by an external heat exchanger with descending flow through a bundle of tubes.

The cooled catalyst is recycled to the regenerator through a conduit for circulating the catalyst upwardly in fluidized state, in the dense bed of this regenerator. The catalyst in the exchanger is kept in the dense bed by a fluidization gas which flows counter-currently to the direction of flow of the catalyst, and fluidization gas is either entrained with it when flow is very weak, or is removed via the intake line for the catalyst. This counter-current circulation of the gas disrupts flow of the catalyst in the intake tube and in the exchanger, and the heat exchange is not at a maximum.

U.S. Pat. No. 4,443,245 discloses a regenerator on two levels, comprising an external exchanger with lateral intake of the hot catalyst coming from the upper level which is a storage zone.

The cooled catalyst is recycled through a conduit, which receives regeneration air and the used up catalyst, in a zone at the lower level where combustion takes place. Therefore, functioning of the regenerator and of the exchanger are closely connected since the return of the cooled catalyst to the regenerator is dependent on the flow of fluidization air used for regeneration and which circulates in said conduit. This patent also discloses a small tube above the exchanger which opens into the dense bed of the exchanger in such a way that discharge of the gas and fumes cannot be complete in view of the presence of the catalyst in this tube. The catalyst circulation with backmixing phenomenon can then appear. Discharge of the gas deteriorates as the exchange bundle meets the upper end of the exchanger. The mixture does not have to be homogeneous, and therefore an upper zone exists where the catalyst stagnates and where it is not properly regenerated. This mans that heat exchange is reduced.

U.S. Pat. No. 4,923,834 discloses a "backmixing" process where an upper tube opening into the intake conduit into the catalyst exchanger which circulates in dense bed enables the catalyst to be returned from the exchanger into the storage chamber of the regenerator. This patent is therefore concerned with cooling by "backmixing and not with a solution to a problem connected with the removal from a heat exchanger of fumes and fluidization air permitting optimization of the heat exchange operation.

Finally, the prior art is illustrated by the patent French Patent 2628342 (U.S. Pat. No. 4,965,232) which discloses an external system for cooling the catalyst in a unit comprising a double regeneration of the spent catalyst providing for a catalytic cracking apparatus, the two regenerators providing for separate removal of the combustion effluents, the catalyst circulating from the second regenerator to the first via the heat exchanger. The technical problem is also concerned with finding a maximum heat exchanger. In fact, the catalyst is not supplied properly to the heat exchanger through an inclined conduit because of a quasi-absence of space for release of the fluidization gas from the catalyst in the exchanger, which means that the fluidization gas tends to rise in the conduit in the form of bubbles, therefore acting against flow of the catalyst.

The present invention aims to remedy the drawbacks mentioned hereinabove and to permit significantly improved results.

SUMMARY OF THE INVENTION

To be more precise, the invention relates to a process for the regeneration in fluidized bed of a catalyst contaminated with coke deposited thereon, wherein the catalyst to be regenerated and a gas containing oxygen are introduced into a first regeneration zone where it is regenerated, at least in part, under suitable conditions in dense bed, the gaseous effluents from the first regeneration operation are separated and are removed by their own means preferably in the upper part of the first regeneration zone, and the catalyst is drawn off, at least in part regenerated, from the first zone so as to be conveyed to the second regeneration zone which is separate from the first regeneration zone where it is regenerated at a temperature above that in the first regeneration zone, and the catalyst is separated from the fumes of the second regeneration operation which are removed at least in part, the process being characterised by the following steps:

a) A part, at least, of the catalyst contained in the second regeneration zone and also a part of the fumes are conveyed downwardly through an inclined conduit into an external heat exchange zone of appropriate height, said conduit connecting the dense bed of the second regeneration zone to heat exchange zone and opening there at a junction point placed in such a way that the lower end of said heat exchange zone up to above said junction point defines a zone of catalyst in dense bed substantially level with the catalyst in the regeneration zone and a discharge zone of appropriate volume in said heat exchange zone above said dense bed as far as the upper end of the heat exchange zone, b) the catalyst is cooled in at least part of said zone in dense bed under suitable indirect heat exchange and fluidisation conditions, in the presence of a fluidisation gas which preferably contains oxygen, the catalyst circulating towards the bottom at counter-current to the direction of flow of the fluidisation gas, c) the catalyst and fluidization gas and also any regeneration fumes in said volume of the discharge zone are separated, d) said gases and fumes from step c) are removed from the discharge zone, and they are conveyed into the diluted phase above the dense bed of the second regeneration zone; and e) the cooled catalyst is drawn off from the lower part of the heat exchange zone, and is recycle in the first regeneration zone.

The invention is advantageous in that it is very easy to use. By connecting the degassing line to the discharge zone for the fumes and fluidization gases of the catalyst in the upper part of the heat exchange which is of adequate volume above the level of the dense bed, flow of the catalyst is promoted from the second regenerator around the bundle of exchanger tubes. Therefore, its flow into the conduit which supplies the exchanger is promoted. Moreover, al the flow of catalyst which can be increased to satisfy the heat equilibrium conditions in the unit as a function of the severity of the charge passes through the exchanger and helps improve the heat exchange and thus control it.

According to a first variant, the cooled catalyst can be recycled by force of gravity either directly into the bed in dense phase in the first regeneration zone or directly in the diluted phase of the first regeneration zone.

According to a second variant, which enables the balance of pressures to be better satisfied, the cooled catalyst can be recycled in the dense phase of the first regeneration zone, advantageously above the fluidisation member. In this case, the catalyst descends by force of gravity into a conduit which is connected at a Y-shaped or J-shaped junction. It then rises again, is accelerated by suitable means in the presence of a fluidization gas, as far as the dense phase of the catalyst. A valve disposed on the conveyance conduit is preferably beneath the level of the lower end of the first regeneration zone and permits manual or automatic control of the flow of catalyst is from 1 to 2 m/s, for example, in the descending part of the conduit, and from 5 to 12 m/s in the ascending part. The rising gas of the catalyst usually assists its fluidization in the first regeneration zone, and if it contains oxygen, which is usually does, its regeneration is also assisted.

The catalyst which passes through the heat exchanger is usually cooled by 50° to 300° C.

According to one feature of the invention, the fluidization speed in the exchanger is usually between 0.025 m/s and 1 m/s, advantageously between 0.05 and 0.5 m/s, and preferably between 0.1 and 0.4 m/s. Under these preferred conditions, a better heat exchange coefficient is observed. According to another feature, the fluidization speed in the second regenerator is usually between 0.6 and 1.5 n/s, and advantageously between 0.8 and 1.2 l m/s.

To permit satisfactory discharge of fluidization gas and catalyst regeneration fumes, an exchanger is usually selected which is a height such that the available space for the discharge of fludisation gas and fumes corresponds to a height of between 0.1 and 5 m, and preferably between 1 and 2.5 m above the level of the dense bed in the second regeneration zone.

The gases and fumes can be removed from the discharge zone at a speed of between 2 and 15 m/s, advantageously between 5 and 8 m/s.

The diameter of the discharge tube is usually such that the loss of charge is restricted to 0.1 bar, for example. This corresponds to a ratio of the diameter of the tubes for intake of the catalyst and removal of the gases which is usually less than or equal to 10, for example between 3 and 6.

According to one advantageous embodiment, almost the entire indirect heat exchange process can be effected below the junction point of the inclined conduit for intake of hot catalyst into the heat exchanger. Under these conditions, the heat exchange is maximized since the entire surface area of the exchanger is in contact with all of the catalyst circulating therein.

According to another embodiment, a part of the cooling tubes in the exchanger can pass beyond the junction point, so that they almost reach the upper level of the dense phase.

The flow of catalyst passing through the exchanger, and thus also the regulation of heat, are usually controlled by a valve at the outlet from the exchanger in a conduit which is substantially elongate and which recycles the cooled catalyst in the first regenerator. This valve is usually under the control of suitable control means which are connected to a temperature probe situated either in the dense bed or in the fluidized bed of the second generator and which usually makes a continuous comparison between the temperature signal and a reference signal which ha been determined beforehand as a function of the regeneration parameters and type of the charge.

These control means can possibly be under the control of a valve which controls the flow of fluidization air in the first regenerator.

According to another embodiment, it is also possible to measure the temperature for first regeneration by using a temperature probe which is preferably immersed in the dense bed, and to use said control means to act upon an opening valve for the catalyst from the outlet of the exchanger and also possibly the control valve for the flow of air in the first regenerator.

The invention also relates to an apparatus for regeneration in fluidized bed of a catalyst contaminated with coke, comprising a first regenerator (1) which comprises intake means (2) for a used up catalyst, fluidization means (5) and regeneration means for the catalyst using a gas containing oxygen, said means operating in fluidized bed in dense phase (3), first separation means (6) for the regeneration fumes of the catalyst which has been partly regenerated and first removal means (7) for said fumes, means (10) for conveying said catalyst from the first regenerator to a second regenerator (9) defined hereinafter, the second regenerator comprising means for fluidization and for regeneration (12) of the catalyst which has been regenerated at least in part by a gas containing oxygen, said means operating in fluidized bed in dense phase (19) as far as an appropriate level (19*a*), second separation means (17) for the regeneration fumes from the regenerated catalyst and second means for removal (18) of said fumes separated from the first removal means, said apparatus being characterised in that is comprises, in combination:

an external, vertical, elongate heat exchanger (21) of suitable height which receives the hot catalyst and possibly a part of the fumes through an inclined conduit (20) connecting said dense bed of the second regenerator to the exchanger, and which cools it as it circulates through the exchanger in a downward direction, said exchanger comprising means (24) for fluidization of the catalyst using a gas at the lower end, the means forming a dense bed at an appropriate level (19*b*), said inclined conduit (20) opening into the exchanger (21) at a junction point disposed beneath the level (19*a*) of the dense bed of the second regenerator (9) at a spacing from the upper end (26) thereof, in such a way that separation is possible of possible regeneration fumes and fluidization gas from the catalyst in the upper part (27) of the exchanger or discharge zone disposed above the level of the dense bed in the exchanger.

Means (28) for removal of the fumes and fluidization gas from the discharge zone at the upper part of the exchanger, the means being connected to the second regenerator (9) at a point above the level (19*a*) of the dense bed of the catalyst, in said regenerator; and withdrawal and recycling means (34, 30) for circulating the cooled catalyst from the lower end of the exchanger to the first regenerator.

The junction point of the heat exchanger with the inclined conduit can be disposed at a spacing away from the upper end of the exchanger between a quarter and a half of the total height, preferably between a quarter and a third.

The amount of catalyst cooled by the exchanger is usually less than 150% by weight of the catalyst circulating in the first regeneration zone. It has been noted that an excellent regeneration rate is obtained with an amount of cooled catalyst of between 15 and 50% by weight.

The heat exchangers can be of the per se known kind, such as those described in the patent FR 2628432, and they are usually in the form of bundles of tubes for indirect heat exchange with the catalyst (coiled tubes, U-shaped tubes, pin-tubes or bayonet-type tubes). The catalyst can circulate either inside or outside. The wall of the heat exchanger can possible comprise a tube-membrane surface. The cooling fluid which circulates in the exchanger can be air, water, water vapour or mixtures of these fluids.

The regenerated catalyst according to the invention is also of the conventional kind, such as silica-aluminas of the zeolite kind which advantageously have a grain size of 30 to 100 micrometers.

BRIEF DESCRIPTION OF FIGURES

The invention will be better understood in the light of the attached figure, which is a schematic elevation illustrating the process and apparatus.

DETAILED DESCRIPTION OF FIGURE

A first regenerator 1 coming from a catalytic cracking unit receives a zeolite catalyst which comes from a stripper separator, not shown and coke has been deposited on this catalyst during the catalytic cracking reaction. The line opens into the catalytic bed at a suitable place, preferably in the diluted phase disposed above the dense fluidized bed 3. A regeneration gas containing oxygen is supplied via a line 4 into a fluidization member 5 such as a grating, a ring or a distribution pipe at the base of the regenerator, and permits fluidization in dense bed of the catalyst and continuous combustion of about 50 to 90% of the coke. The regeneration fumes and the catalyst which are entrained are separated in cyclones 6, and the regeneration fumes containing major combustion products in the form of carbon monoxide, carbon dioxide and water vapour are removed via the line 7 towards the burner.

The temperature of the fluidized bed 3 is measured using a probe 8. When this temperature decreases below a recommended value T1, owing to the introduction of relatively cold catalyst introduced through the lines 34, as will be seen hereinafter, the flow of oxidizing fluid (fluidization fluid) supplied to the fluidization member 5 and controlled by a control valve 33 on the line 4 is increased until the temperature measured at 8 meets the recommended value.

The catalyst particles which have been partially regenerated are then conveyed to a second regenerator 9 placed above the first regenerator 1, via the conduit 10 supplied with air by the line 11. At the bottom of the second regenerator there is a diffuser 12 which is supplied with air by the line 13. The catalyst which has been partially regenerated undergoes combustion in the dense bed 9, the upper part of which defines a level 19*b* at a suitable height, depending on the aeration provided.

A part of the particles of the regenerated catalyst is removed laterally into a plugged chamber 14. In this chamber, fluidization of the particles is usually controlled by an annular diffuser 15 which is supplied with fluidization gas such as air or inert gas via a line 16. From the chamber 14, the particles of regenerated catalyst are recycled by a conduit 35 for supplying a riser, not shown, with an amount determined by opening or closure of a valve. At the upper part of the second regenerator, the combustion gases are separated from the catalyst particles by the external cyclones 17 and are removed via the line 18, separate from the line 7 for removal of the fumes of the first regeneration.

A part of the hot catalyst and a part of the fumes at a temperature of between 600° and 850° C. are removed from the dense bed 19 of the second regenerator at a point situated above the air injection member 12 and are supplied by force of gravity, by virtue of a downwardly inclined conduit 20, which may be at an angle of 30° to 60° relative to the axis of the exchanger, into a heat exchanger 21 for indirect heat exchange. The exchanger is vertical, elongate, cylindrical and contains an exchange bundle comprising coiled tubes 22, for example, wherein a suitable fluid such as pressurized water circulates w'ich is supplied by a line 23*a*. The water vapour from this heat exchange is recovered by line 23*b*. The bundle of tubes is advantageously disposed beneath the inclined conduit in such a way that the catalyst which is drawn off circulates through the bundle, from the top to the bottom. At the lower end of the exchanger, a fluidization means 24 (ring or grating) introduces air which is supplied by a line 25 counter-currently to the direction of flow of the catalyst, and keeps the catalyst in the dense bed through the bundle of tubes.

The conduit 20 for supply of the hot catalyst, which conduit is inclined at an angle of 30° to 60° relative to the axis of the exchanger opens into this exchanger at a junction point situated beneath the level 19*a* of the dense bed of the second regenerator, for example, at a point situated at a distance away from the upper end 26 f the exchanger between one quarter and one third of its height, in such a way that in the upper part of the exchanger the catalyst in dense bed reaches a suitable level 19*b* which is a function of the respective fluidization speeds in the second regenerator and the heat exchanger and thus of the respective volume masses. Thus, a slight difference can occur between the levels of catalyst in the regenerator and exchanger.

The height of the exchanger is selected in such a way that in relation to the level in the regenerator, a free zone known as the discharge zone 27 of 1 to 2.5 m is formed in the exchanger to enable the fluidization gas to be separated from any possible fumes due to regeneration of the catalyst. A degassing line 28 removes the fumes and the gases from the diluted phase at the upper end of the exchanger towards the diluted fluidized phase 29 above the dense fluidized bed of the second regenerator. The diameter thereof is selected in such a way that the ratio of the diameter of the degassing line to that of the conduit 20 for intake of the catalyst is between 3 and 6. The exit speed of the gasses is usually between 2 and 15 m/s.

The drawing off and recycling means 34 comprise a substantially vertical conduit 34*a* in which the catalyst flows by the force of gravity, the conduit being connected at a Y-shaped or J-shaped junction 34*b* situated below the first regenerator. The catalyst is conveyed via a lift 36 which is connected at the junction 34*b* which accelerates the catalyst due to the fluidization air 37 in the conduit 34*c*, and recycles it in the dense phase of the first regenerator, preferably above the fluidization member 5.

At the exit from the exchanger 21, the valve 30 which may be in the form of a slide valve, and which is disposed beneath the lower end of the first regenerator and upstream of the "lift" permits control of the flow of catalyst which is being conveyed from one regenerator to the other as soon as the temperature of the regenerated catalyst exceeds the required recommended value.

The flow of catalyst which passes through the heat exchanger is adjusted to keep the temperature prevailing in the second regenerator, and thus finally the intake temperature into the reaction zone (riser) at a recommended temperature which is suitable for the cracked charge in the unit.

Thermal control of the regeneration operation is achieved by the combination of the following components:

Control and regulatory means 31 are connected to the valve 30 disposed on the conduit 17 for removal of the catalyst from the exchanger. These means are also connected to a temperature probe 32 disposed in the dense bed of the second regenerator 9. When the signal emitted by the probe reaches a value which is greater than the recommended value selected beforehand as a function of the regeneration parameters, and which value has been stored by the regulatory means, these latter send a signal to the valve 30 which increases the discharge flow of the catalyst and thus increases the intake flow of catalyst into the exchanger. This increase in flow causes a temperature decrease in the first regeneration operation which is registered by the temperature probe 8, and this temperature decrease is then compensated for by means 31 which increase the supply of oxygen by virtue of a valve 33 on the line 4 which supplies the fluidization injector of the first regenerator. A larger amount of coke can then be burned there.

On the other hand, when the signal emitted by the probe 32 reaches a value which is less than the recommended value, the valve 30 is partly closed in such a way that the heat exchange is reduced. In parallel, the consumption of oxygen decreases in the first regenerator, and therefore less coke is burned which helps increase the temperature of the catalyst in the second regenerator. As a result of this, the temperature is kept substantially constant within the desired range of values.

| | |
|---|---|
| Flow of catalyst in the exchanger | 5 88 000 kg/h |
| Temperature of dense bed in second regenerator | 720° C. |
| Outlet temperature from exchanger | 550° C. |
| Amount of fluidization air in exchanger | 2 200 kg/h |
| Height of exchange bundle (coils) | 5.8 m |
| Height of discharge zone | 2.5 m |
| Amount of heat exchanged | $125 \times 10^6$ KJ/h |
| Flow of vapour generated | 75 000 kg/h |
| Temperature of vapour | 258° C. |
| Vapour pressure | 4.5 MPa |

We claim:

1. A process for the regeneration in a fluidized bed of a catalyst contaminated with coke deposited thereon, wherein the catalyst to be regenerated and a gas containing oxygen are introduced into a first regeneration zone where the catalyst is partially regenerated in a first fluidized dense bed, the gaseous effluents from the first regenerator operation are separated and are removed by a first separator, and the resultant partially regenerated catalyst is drawn off from the first zone and conveyed to a second fluidized dense bed in a second regeneration zone separate from the first regeneration zone where said resultant catalyst is further regenerated at a temperature above that in the first regeneration zone, and the further regenerated catalyst is separated from fumes resulting from the second regeneration operation, said fumes being also at least partly removed from said second regeneration operation by a second separator, said first and second separators being distinct from one another, said process comprising the following steps:

(a) conveying a part, at least, of the catalyst contained in the second regeneration zone and also a part of the fumes downwardly through an inclined conduit into an external elongated heat exchanger comprising a heat exchange zone having an upper end and a lower end, said conduit connecting the second fluidized dense bed of the second regeneration zone at a junction point in the heat exchange zone, the lower end of said heat exchange zone up to above said junction point defining a zone of the catalyst in a third fluidized dense bed substantially level with the catalyst in the second regeneration zone, and, above said third fluidized dense bed, said heat exchanger further comprising a discharge zone having a discharge volume devoid of heat exchange tubes up to the upper end of the heat exchanger sufficiently large to permit separation of gases and fumes from the catalyst;

(b) cooling the catalyst in at least part of said heat exchange zone in said third fluidized dense bed under indirect heat exchange and fluidization conditions, in the presence of a fluidization gas containing oxygen, the catalyst circulating towards said lower end countercurrently to the direction of flow of the fluidization gas;

(c) separating the catalyst and the fluidization gas and also any regeneration fumes in said discharge volume of the discharge zone;

(d) removing said gases and fumes from step (c) from the discharge zone and conveying said gases and fumes into the diluted phase above the second fluidized dense bed of the second regeneration zone; and (e) withdrawing the resultant cooled catalyst from the lower end of the heat exchange and recycling the withdrawn catalyst into the first regeneration zone.

2. A process according to claim 1, wherein the gas containing oxygen is introduced into the first regeneration zone through has injection means, and the recycling of the catalyst takes place above the gas injection means of the first regeneration operation.

3. A process according to claim 1, wherein the cooled catalyst is allowed to flow by the force of gravity to a Y-shaped and J-shaped junction below the first regeneration zone, and from said junction, the cooled catalyst is passed upwardly to the first regeneration zone.

4. A process according to claim 1, wherein the fluidization velocity in the heat exchange zone is between 0.025 m/s and 1 m/s.

5. A process according to claim 1, wherein the fluidization velocity in the second regeneration zone is between 0.6 m/s and 1.5 m/s.

6. A process according to claim 1, wherein the height of the heat exchange zone is such that the volume available for discharge of the fluidization gas and fumes is equal to a height of 0.1 m to 5 m above the level of the dense fluidized bed in the second regeneration zone.

7. A process according to claim 1, wherein the gas is removed from the discharge zone at a velocity of between 2 m/s and 15 m/s.

8. A process according to claim 1, wherein all indirect heat exchange in step (b) takes place below the junction point.

9. A process according to claim 1, wherein flow of the catalyst downwardly through the heat exchange zone is adjusted by at least one valve downstream of the heat exchange zone, the valve setting being responsive to a temperature setting in the first or second regeneration zone.

10. A process according to claim 1, wherein the fluidization velocity in the heat exchange zone is between 0.05 m/s and 0.5 m/s.

11. A process according to claim 1, wherein the fluidization velocity in the second regeneration one is between 0.8 m/s and 1.2 m/s.

12. A process according to claim 1, wherein the height of the heat exchange zone is such that the volume available for discharge of the fluidization gas and fumes is equal to a height of 1 m and 2.5 m above the level of the dense fluidized bed in the second regeneration zone.

13. A process according to claim 1, wherein the gas is removed from the discharge zone at a velocity of between 5 m/s and 8 m/s.

14. A process according to claim 1, wherein the second regeneration zone is superposed above the first regeneration zone.

15. A process according to claim 14, wherein the gas containing oxygen is introduced into the first regeneration zone through gas injection means, and the recycling of the catalyst takes place above the gas injection means of the first regeneration operation.

16. A process according to claim 15, wherein the height of the heat exchange zone is such that the volume available for discharge of the fluidization gas and fumes is equal to a height of 1 m to 2.5 m above the level of the dense fluidized bed in the second regeneration zone.

17. A process according to claim 16, wherein all indirect heat exchange in step (b) takes place below the junction point.

18. A process according to claim 1, wherein flow of the catalyst downwardly through the heat exchange zone is adjusted by at least one valve downstream of the heat exchange zone, the valve setting being responsive to a temperature setting in the first or second regeneration zone.

19. A process according to claim 18, wherein the valve setting is responsive to a temperature setting in the second regeneration zone, and the amount of gas containing oxygen is adjusted in response to the temperature in the first regeneration zone.

20. A process according to claim 9, wherein the valve setting is responsive to a temperature setting in the second regeneration zone, and the amount of gas containing oxygen is adjusted in response to the temperature in the first regeneration zone.

21. A process according to claim 2, wherein all indirect heat exchange in step (b) takes place below the junction point.

* * * * *

UNITED STATES PATENT AND TRADEMARK OFFICE

CERTIFICATE OF CORRECTION

PATENT NO. : 5,324,696

DATED : June 28, 1994

INVENTOR(S) : Regis BONIFAY et al.

It is certified that error appears in the above-indentified patent and that said Letters Patent is hereby corrected as shown below:

Title page, Under Foreign Patent Documents: Change "2626342" to read -- 2628342 --.

Claim 3, Column 9, Line 39: Delete "and" and insert -- or --.

Signed and Sealed this

Sixth Day of December, 1994

Bruce Lehman

*Attest:*

BRUCE LEHMAN

*Attesting Officer*

*Commissioner of Patents and Trademarks*